US009854351B2

(12) United States Patent
Han et al.

(10) Patent No.: US 9,854,351 B2
(45) Date of Patent: Dec. 26, 2017

(54) SPEAKER DEVICE COMPRISING STRUCTURE INSIDE HOUSING

(71) Applicant: Samsung Electronics Co., Ltd., Gyeonggi-do (KR)

(72) Inventors: Byung Gon Han, Gyeonggi-do (KR); Soo Jin Park, Gyeonggi-do (KR); Gun Lim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/187,256

(22) Filed: Jun. 20, 2016

(65) Prior Publication Data

US 2016/0373854 A1 Dec. 22, 2016

(30) Foreign Application Priority Data

Jun. 19, 2015 (KR) ..... 10-2015-0087789

(51) Int. Cl.
*H04R 1/28* (2006.01)
*H04R 1/02* (2006.01)

(52) U.S. Cl.
CPC ..... *H04R 1/2834* (2013.01)

(58) Field of Classification Search
CPC ..... H04R 1/283; H04R 1/2834
See application file for complete search history.

(56) References Cited

U.S. PATENT DOCUMENTS

| | | | |
|---|---|---|---|
| 5,850,460 | A | 12/1998 | Tanaka et al. |
| 7,133,533 | B2 | 11/2006 | Chick et al. |
| 7,974,431 | B2 | 7/2011 | Saiki |
| 8,031,896 | B2 | 10/2011 | Chick et al. |
| 8,085,950 | B2 | 12/2011 | Suzuki |
| 8,130,998 | B2 | 3/2012 | Koyama |
| 8,160,286 | B2 | 4/2012 | Koike et al. |
| 8,594,358 | B2 | 11/2013 | Litovsky et al. |
| 8,798,308 | B2 | 8/2014 | Litovsky et al. |
| 2005/0018868 | A1 | 1/2005 | Chick et al. |
| 2006/0291684 | A1 | 12/2006 | Chick et al. |
| 2007/0092096 | A1 | 4/2007 | Litovsky |
| 2007/0201712 | A1 | 8/2007 | Saiki |
| 2008/0013750 | A1 | 1/2008 | Suzuki |
| 2008/0279406 | A1 | 11/2008 | D'Hoogh |
| 2009/0316933 | A1 | 12/2009 | Koyama |
| 2010/0027815 | A1 | 2/2010 | Burge |
| 2010/0061584 | A1* | 3/2010 | Lin ..... H04R 1/02 381/386 |
| 2010/0111343 | A1 | 5/2010 | Hsu |
| 2011/0243361 | A1 | 10/2011 | Koike et al. |
| 2012/0033826 | A1 | 2/2012 | Kakumoto |

(Continued)

*Primary Examiner* — Mark Fischer
(74) *Attorney, Agent, or Firm* — The Farrell Law Firm, P.C.

(57) ABSTRACT

A speaker device includes a housing, first speaker unit disposed at a front surface of the housing, a second speaker unit disposed at the front surface, a first passive radiator disposed at the front surface, a second passive radiator disposed at a rear surface of the housing, and at least one structure disposed inside the housing, where the one of the at least one structure is disposed between the first passive radiator and the second passive radiator and disposed to form a gap, through which air flows, between the structure and at least one of the housing, the first speaker unit, the second speaker unit, and another of the at least one structure.

11 Claims, 8 Drawing Sheets

(56) References Cited

U.S. PATENT DOCUMENTS

| | | | |
|---|---|---|---|
| 2012/0051573 | A1 | 3/2012 | Litovsky et al. |
| 2013/0213628 | A1 | 8/2013 | Litovsky et al. |
| 2014/0193005 | A1 | 7/2014 | Riggs |

* cited by examiner

SPEAKER DEVICE COMPRISING STRUCTURE INSIDE HOUSING

PRIORITY

This application priority under 35 U.S.C. §119(a) to a Korean Patent Application filed on Jun. 19, 2015, in the Korean Intellectual Property Office and assigned Serial number 10-2015-0087789, the entire disclosure of which is incorporated herein by reference.

BACKGROUND

1. Field of the Disclosure

The present disclosure relates generally to a speaker device, and more particularly, to a speaker device including a structure for controlling the flow of air.

2. Description of the Related Art

With the development of digital technology, a conventional analog type sound source may be changed into a digital type sound source and thus, people may store digitally-sampled sound source files in computers and storage media. Accordingly, the transmission of digital sound sources is now possible and portable devices such as MP3 players have emerged.

Users are able to listen to digital sound sources anywhere by using the portable devices with earphones, the speakers of the portable devices, or external portable speaker devices, as a means for playing the digital sound sources.

However, since the speaker devices require a large cabinet capacity in order to play the bass bands of the digital sound sources, it is difficult to play bass with a small speaker device, such as a portable speaker device.

SUMMARY

The present disclosure has been made to address at least the above-mentioned problems and/or disadvantages and to provide at least the advantages described below.

Accordingly, an aspect of the present disclosure is to provide a speaker device for controlling a portion of the flow of air by using a structure therein.

Accordingly, another aspect of the present disclosure is to solve a vibration issue occurring from a speaker when a sound source is played by controlling a portion of the flow of air with a structure.

Accordingly, another aspect of the present disclosure is to allow a flow of air through a plurality of speakers and a plurality of radiators of a speaker device, thereby reducing the heat generation of the speaker device.

In accordance with an aspect of the present disclosure, a speaker device is provided. The speaker device includes a housing, first speaker unit disposed at a front surface of the housing, a second speaker unit disposed at the front surface, a first passive radiator disposed at the front surface, a second passive radiator disposed at a rear surface of the housing, and at least one structure disposed inside the housing, where the one of the at least one structure is disposed between the first passive radiator and the second passive radiator and disposed to form a gap, through which air flows, between the structure and at least one of the housing, the first speaker unit, the second speaker unit, and another of the at least one structure.

BRIEF DESCRIPTION OF THE DRAWINGS

The above and other aspects, features, and advantages of the present disclosure will be more apparent from the following description taken in conjunction with the accompanying drawings, in which.

DETAILED DESCRIPTION OF EMBODIMENTS OF THE PRESENT DISCLOSURE

Figure 1:
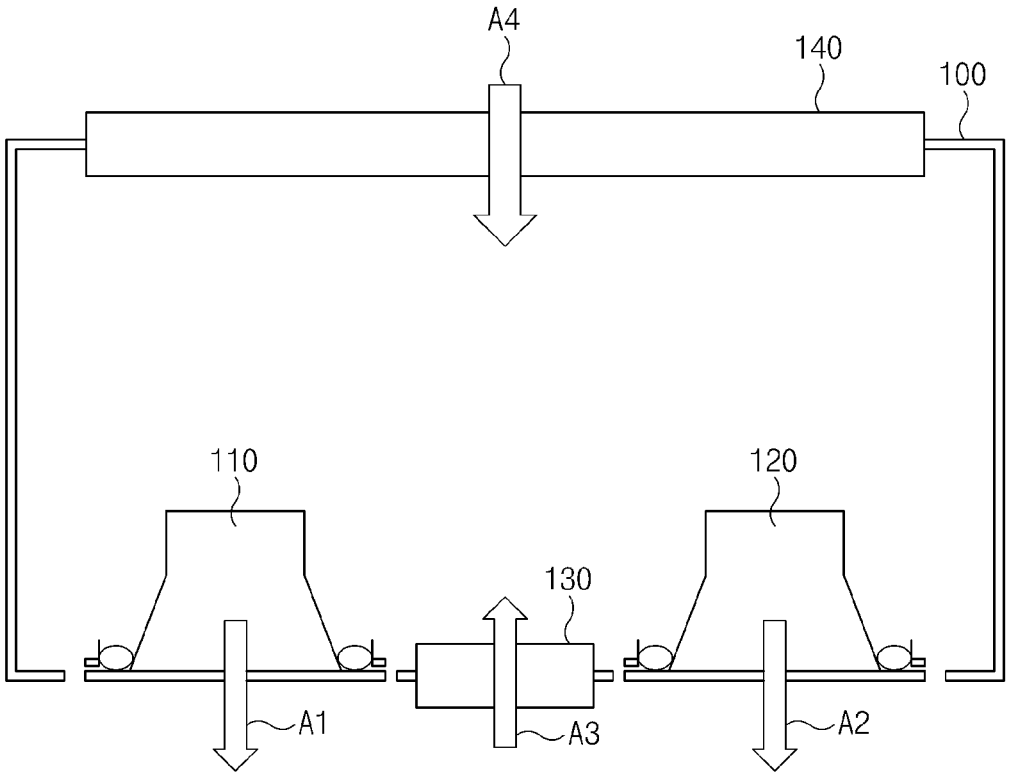
FIG.1 PRIOR ART
FIG. 1 illustrates inflow of air through a conventional speaker device.

Hereinafter, various embodiments of the present disclosure are disclosed with reference to the accompanying drawings. However, this does not limit various embodiments of the present disclosure to a specific embodiment and it should be understood that the present disclosure covers all modifications, equivalents, and/or alternatives of this disclosure provided they come within the scope of the appended claims and their equivalents. With respect to the descriptions of the drawings, like reference numerals refer to like elements.

The terms "include," "comprise," and "have" used herein indicate disclosed functions, operations, or existence of elements, but do not exclude other functions, operations, or elements.

For instance, the expressions "A or B", or "at least one of A or/and B" may indicate include A, B, or both A and B. For instance, the expressions "A or B", or "at least one of A or/and B" may indicate (1) A, (2) B, or (3) both A and B.

Terms such as "1st", "2nd", "first", "second", and the like used herein may refer to modifying various elements, but do not limit the elements. For instance, "a first user device" and "a second user device" may indicate different user devices regardless of the order or the importance. For example, a first component may be referred to as a second component and vice versa without departing from the scope of the present disclosure.

In various embodiments of the present disclosure, it will be understood that when a component (for example, a first component) is referred to as being "(operatively or communicatively) "coupled"" or "connected" with/to" another component (for example, a second component), the first component may be directly connected to the second component or connected through another component (for example, a third component). However, when a component (for example, a first component) is referred to as being "directly "coupled" or "connected" with/to" " " another component (for example, a second component), another component (for example, a third component) does not exist between the first component and the second component.

The expression "configured to" used in herein may be used interchangeably with expressions such as "suitable for", "having the capacity to", "designed to", "adapted to", "made to", or "capable of" according to a situation. The term "configured to" may not necessarily mean "specifically designed to" in terms of hardware. Instead, the expression "a device configured to" in some situations may mean that the device is "capable of". For example, "a processor configured (or set) to perform A, B, and C" may mean a dedicated processor (for example, an embedded processor) for performing a corresponding operation or a generic-purpose processor (for example, a CPU or application processor) for performing corresponding operations by executing at least one software program stored in a memory device.

Terms used herein are to describe specific embodiments of the present disclosure, and are not intended to limit the scope of other embodiments. The terms of a singular form may include plural forms unless they have a clearly different meaning in the context. Unless otherwise indicated herein, all the terms used herein, which include technical or scientific terms, may have the same meaning that is generally understood by a person of ordinary skill in the art to which this disclosure pertains. In general, terms defined in general dictionaries should be considered to have the meanings consistent with their meanings in the context of the related art, and, unless clearly defined herein, should not be interpreted in an idealized or excessively formal manner. In some cases, even the terms defined in this specification should not be interpreted as excluding embodiments of the present disclosure.

Hereinafter, a speaker device according to various embodiments of the present disclosure will be described in more detail with reference to the accompanying drawings. The term "user" in this disclosure may refer to a person using an electronic device or a device using an electronic device (for example, an artificial intelligence electronic device).

FIG. 1 illustrates inflow of air through a conventional speaker device 100.

Referring to FIG. 1, a sectional view of a conventional speaker device 100 is provided. The speaker device 100 includes a first speaker unit 110, a second speaker unit 120, a first passive radiator 130, and a second passive radiator 140. The convention speaker device 100 may make sound by moving (or vibrating) a diaphragm back and forth included in each of the first speaker unit 110 and the second speaker unit 120. Each of the first radiator 130 and the second radiator 140 may be a passive radiator and move back and forth in a bass band.

A permanent magnet included in each of the first speaker unit 110 and the second speaker unit 120 may cause the diaphragm to move back and forth. Additionally, as the diaphragm moves back and forth, air may flow from the inside of the speaker device 100 to the outside through the first speaker unit 110 and the second speaker unit 120 or may flow from the outside to the inside of the speaker device 100 through the first speaker unit 110 and the second speaker unit 120.

In FIG. 1, air flows from the inside of the speaker device 100 to the outside through the first speaker unit 110 and the second speaker unit 120. The flow of air from the outside to the inside of the speaker device 100 through the first speaker unit 110 and the second speaker unit 120 may be performed in a manner which is the reverse of that illustrated in FIG. 1.

As the diaphragm of each of the first speaker unit 110 and the second speaker unit 120 moves back and forth, air flows to the outside. In this case, since air inside the speaker 100 becomes insufficient, air flows from the outside to the inside of the speaker device 100 through the first radiator 130 and the second radiator 140. The arrows A1, A2, A3, and A4, shown in FIG. 1, represents the flow of air in each of the first speaker unit 110, the second speaker unit 120, the first radiator 130, and the second radiator 140, respectively.

The directions of air in the first speaker unit 110, the second speaker unit 120, and the second radiator 140 are the same but the directions of air in the first speaker unit 110, the second speaker unit 120, and the second radiator 140 are different from that in the first radiator 130. Accordingly, since the flowing amount of air in the first speaker unit 110, the second speaker unit 120, and the second radiator 140 and the flowing amount of air in the first radiator 130 do not cancelled out each other, vibration may occur in a direction that air moves in the first speaker unit 110, the second speaker unit 120, and the second radiator 140 of the speaker device 100.

The vibration occurring in the speaker device 100 becomes larger as the volume of a sound source increases. Additionally, in this case, as a current amount flowing in a voice coil included in each of the first speaker unit 110 and the second speaker unit 120 increases, heat generation may be increased.

Figure 2:
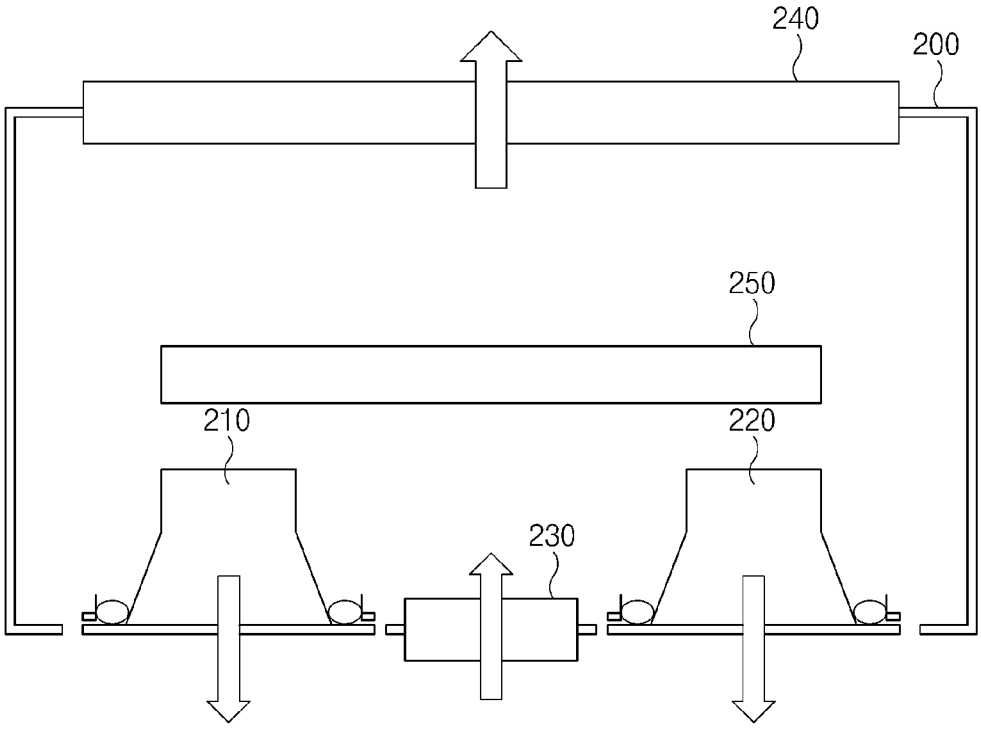
FIG. 2 illustrates inflow of air through a speaker device, according to an embodiment of the present disclosure.

FIG. 2 illustrates inflow of air through a speaker device, according to an embodiment of the present disclosure.

Referring to FIG. 2, a sectional view of a speaker device 200 is provided. As compared to the speaker device 100 of FIG. 1, the speaker device 200 of FIG. 2 may additionally include a structure 250 in a housing of the speaker device 200. An operation of making sound through vibrations of the first speaker unit 210 and the second speaker unit 220 and an operation of making sound through vibrations of the first passive radiator 230 and the second passive radiator 240 correspond to that of the speaker device 100 of FIG. 1 and thus, descriptions thereof are omitted.

The structure 250 is disposed inside the speaker device 200. For example, the structure 250 may be connected to at least one surface of the housing of the speaker device 200 such as a bottom surface or a top surface of the housing of the speaker device 200. For example, the structure 250 may be integrally connected as a portion of the housing of the speaker device 200, and may contact as a separate object by coupling with the speaker device 200. The structure 250, for example, may include a battery for supplying power to the speaker device 200. The structure 250 may be a removable battery insertable from one surface of the housing of the speaker device 200.

Additionally, the structure 250 is spaced apart from at least one surface of the housing of the speaker device 200, thereby forming a gap inside the speaker device 200 where air flows between the structure 250 and another component of the speaker device 200. In more detail, the first surface of the structure 250 may face the first passive radiator 230, and the second surface of the structure 250 may face the second passive radiator 240. At least one of the other surfaces of the structure 250 may be spaced apart from the housing of the speaker device 200, or the first speaker 210, or the second speaker 210 of the speaker device 200. As compared to the case where there is no structure 250, in an embodiment of the present disclosure the structure 250 varies at least a portion of the flow of air. For example, at least a portion of the flow of air may be changed by the gap.

As mentioned above, while a sound source is played by the speaker device 100 in FIG. 1, the flowing directions of air in the first speaker unit 110, the second speaker unit 120, and the second radiator 140 is the same, however, the flowing direction of air in the first passive radiator 130 is opposite from those of the first speaker unit 110, the second speaker unit 120, and the second radiator 140.

On the other hand, while a sound source is played by the speaker device 200 in FIG. 2, the flowing direction of air in each of the first speaker 210 and the second speaker 220 is the same, and the flowing direction of air in each of the first passive radiator 230 and the second passive radiator 240 is the same. Additionally, the flowing direction of air in each of the first speaker 210 and the second speaker 220 is opposite from the flowing direction of air in each of the first passive radiator 230 and the second passive radiator 240. When air flows through the gap, the phase of the air may be changed. The phase of the air, for example, may be changed by at least 90°.

Figure 3:
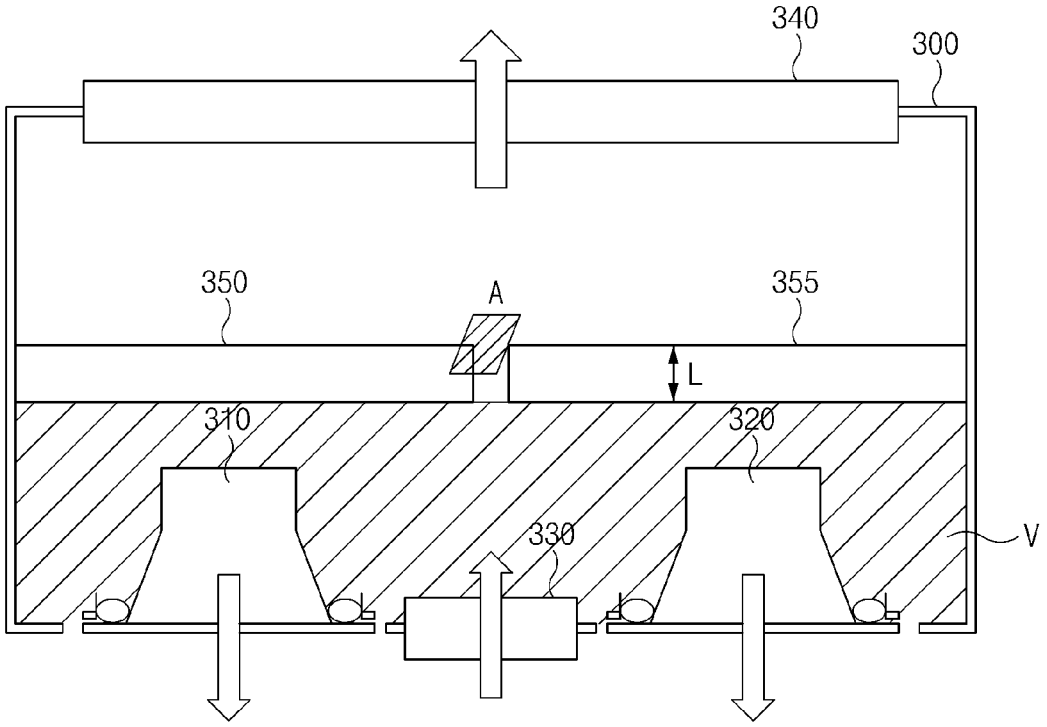
FIG. 3 illustrates the inflow of air through a speaker device according to an embodiment of the present disclosure.

FIG. 3 illustrates the inflow of air through a speaker device according to an embodiment of the present disclosure.

Referring to FIG. 3, a sectional view of speaker device 300 is provided. The speaker device 300 includes a first speaker unit 310, a second speaker unit 320, a first passive radiator 330, and a second passive radiator 340, and a plurality of structures 350 and 355. FIG. 3 illustrates the flow of air through the first speaker unit 310, the second speaker unit 320, the first passive radiator 330, and the second passive radiator 340 when air flows out through the first speaker unit 310 and the second speaker unit 120 by the plurality of structures 350 and 355.

A configuration excluding the structures 350 and 355 in the speaker device 300, shown in FIG. 3, may correspond to the configuration of the speaker device 200, shown in FIG. 2. Accordingly, description for the configuration of the speaker device 200 of FIG. 2, which is applicable to the speaker device 300, will be omitted.

As compared to the speaker device 200, shown in FIG. 2, the speaker device 300, shown in FIG. 3, includes the plurality of structures 350 and 355. The first structure 350 and the second structure 355 are disposed parallel to each other. The first structure 350 and the second structure 355 are spaced at a predetermined interval apart from each other. The predetermined interval is a gap through which air flows. As mentioned with reference to FIG. 2, the gap prevents at least a portion of the flow of air, thereby changing the phase of the air.

The degree that the phase of the air is changed may result from various factors. For example, the factors may include the area A of the gap, the length L of the gap, and the volume V of the gap. In relation to the flow of the air, when resonance occurs, a phase is inverted. As a condition that the resonance occurs, resonant frequency f is defined as Equation (1).

$$\text{Resonant Frequency}(f) = \frac{1}{2\times\pi}\sqrt{\frac{A}{L\times V}} \qquad \text{Equation (1)}$$

Through the above equation, the gap, the first passive radiator 330, and the second passive radiator 340 operate as a mutual resonator.

Figure 4:
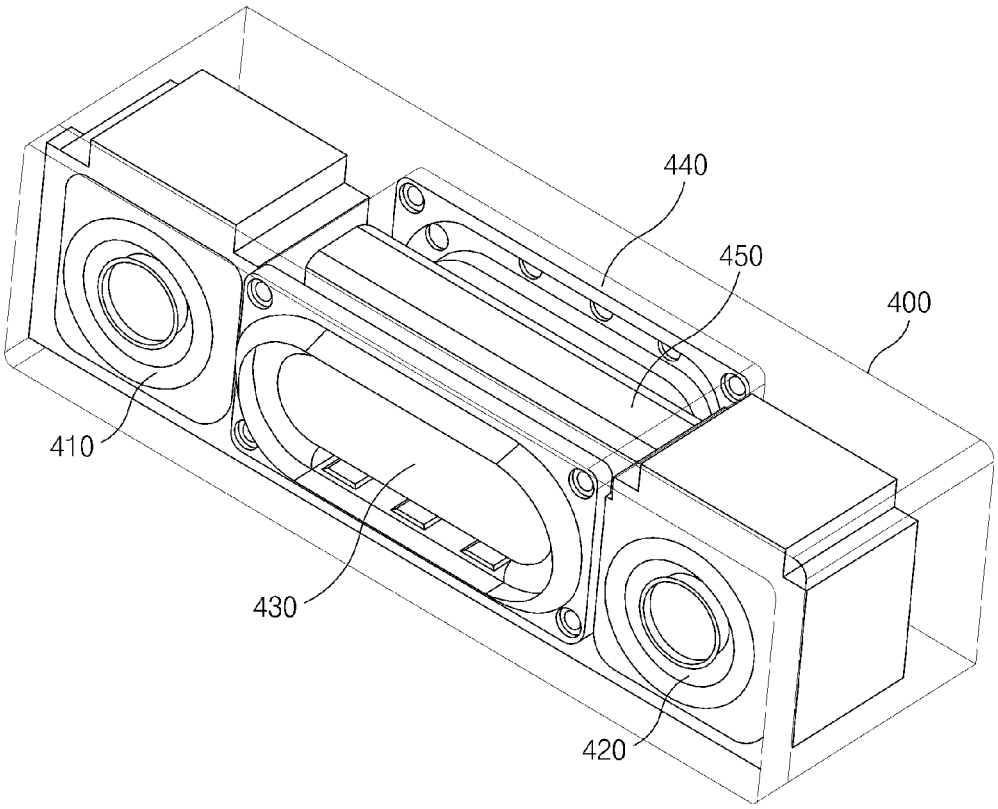
FIG. 4 is a perspective view of external and internal structures of a speaker device, according to van embodiment of the present disclosure.
Figure 5:
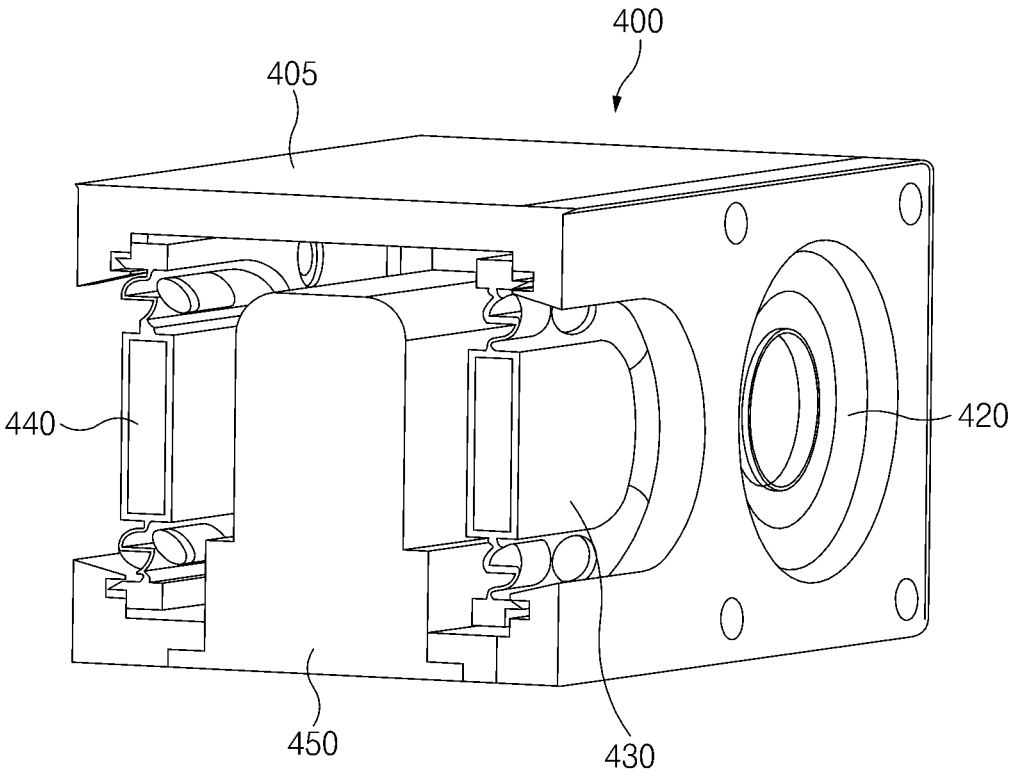
FIG. 5 is a sectional diagram of a speaker device, according to an embodiment of the present disclosure.

FIG. 4 is a perspective view illustrating external and internal structures of a speaker device, according to an embodiment of the present disclosure. FIG. 5 is a sectional diagram of a speaker device, according to an embodiment of the present disclosure.

Referring to FIGS. 4 and 5, the speaker device 400 is provided. Speaker device 400 includes a first speaker unit 410, a second speaker unit 420, a first passive radiator 430, a second passive radiator 440, and a structure 450.

The structure 450 forms a gap through which air flows between the structure 450 and an upper surface housing 405 of the speaker device 400. The gap, as described above, is designed to have a length and an area, which allow the speaker 400 to have a predetermined resonant frequency. Additionally, a volume between the structure 450 and a front surface housing of the speaker device 400 is designed to allow the speaker device 400 to have a predetermined resonant frequency.

Figure 6A:
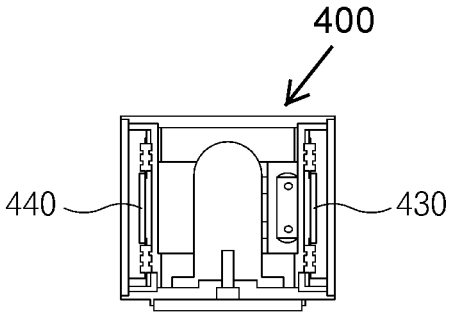
FIG. 6A illustrates a speaker device, according to an embodiment of the present disclosure.
Figure 6B:
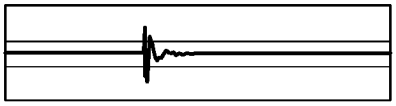
FIGS. 6B-6C are graphs illustrating a phase of air in each of a first passive radiator and a second passive radiator of a speaker device, respectively, according to an embodiment of the present disclosure.
Figure 6C:
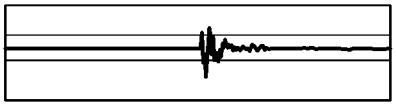

FIG. 6A illustrates a speaker device, according to an embodiment of the present disclosure. FIGS. 6B-6C are graphs illustrating a phase of air in each of a first passive radiator and a second passive radiator of a speaker device, respectively, according to an embodiment of the present disclosure.

Referring to FIG. 6A, the speaker device 400 including the first passive radiator 430 and the second passive radiator 440 is provided.

Referring to FIG. 6B, a graph representing the phase of air in the first passive radiator 430 of the speaker device 400 is provided.

Referring to FIG. 6C, a graph representing the phase of air in the second passive radiator 440 of the speaker device 400 is provided.

Additionally, the graphs shown in FIGS. 6B and 6C may each represent a time difference of the air.

When the speaker device 400 plays a sound source, the first speaker unit 410 and the second speaker unit 420 may vibrate back and forth primarily through a permanent magnet and a coil. In this case, air flows through the first speaker unit 410 and the second speaker unit 420. As the first speaker unit 410 and the second speaker unit 420 are disposed at the front surface of the speaker device 400, the flow of the air may primarily affect the first passive radiator 430 disposed at the front surface of the speaker device 400. Then, the flow of the air may secondarily affect the second passive radiator 440 disposed at the rear surface of the speaker device 400.

As shown in FIGS. 6A-6C, after the flow of air is measured from the first passive radiator 430, the flow of air is measured from the second passive radiator 440 with a predetermined time difference.

Additionally, FIGS. 6A-6C show that the phase of air measured from the first passive radiator 430 and the phase of air measured from the second passive radiator 440 are the inversion of one another. This is because the phase of air is inverted at the resonant frequency f.

According to various embodiments of the present disclosure, the speaker devices 200 to 400 may be connected to an additional electronic device (for example, a smartphone, a CD player, or an MP3 player) for receiving a sound source or a signal to play the sound source. Accordingly, the speaker devices 200 to 400 may include an input/output interface to be connected to the electronic device. The input/output interface, for example, may be a USB connector. Alternatively, the input/output interface may be a BT communication module.

Additionally, according to various embodiments of the present disclosure, the speaker devices 200 to 400 themselves may include a processor and a memory for playing a sound source. The processor may execute a sound source playback program stored in the memory and play a sound source stored in the memory by using the sound source playback program.

When the speaker devices 200 to 400 are an electronic device available for playing a sound source, a configuration of the electronic device will be described with reference to FIGS. 7 and 8.

Figure 7:
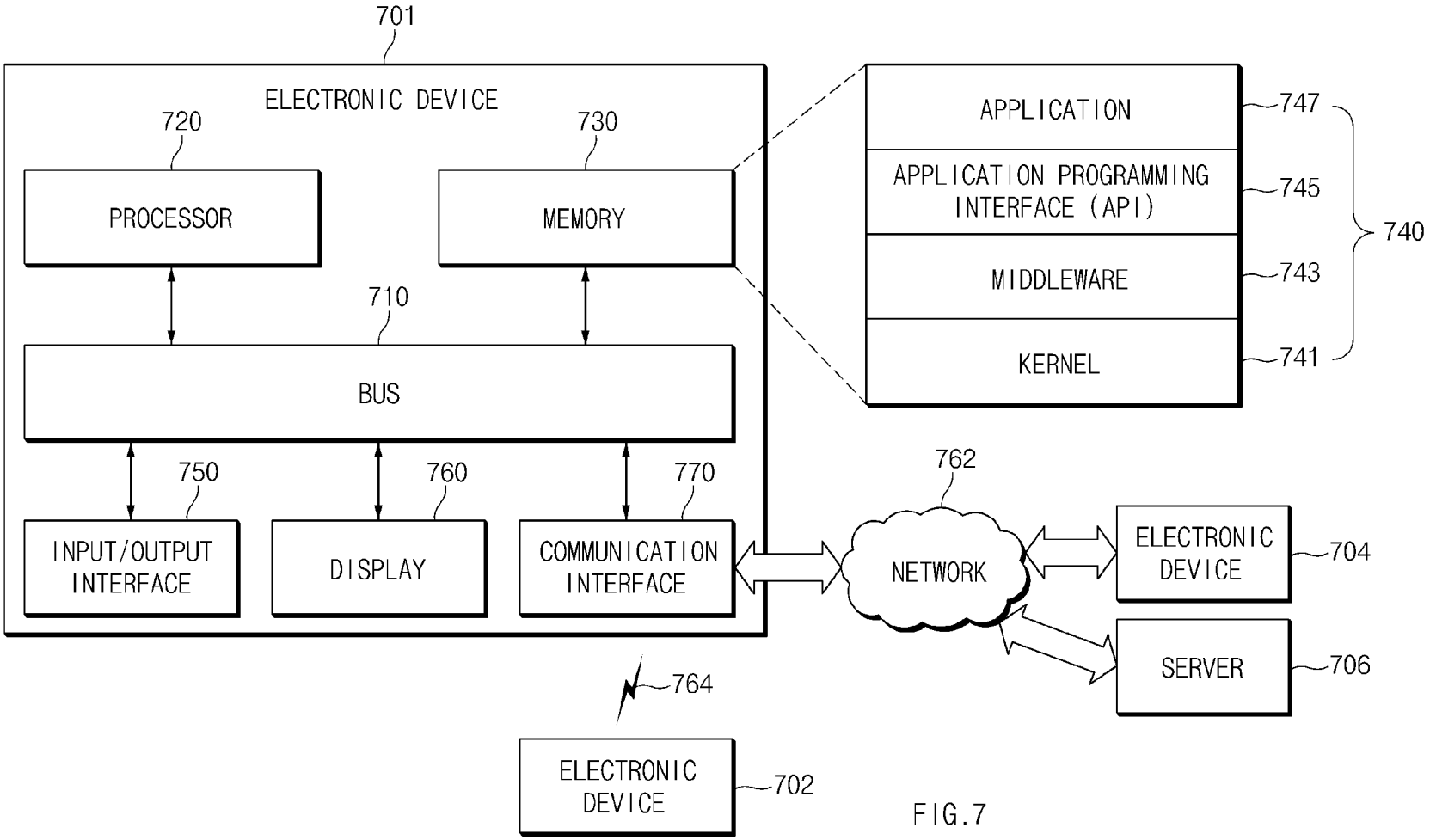
FIG. 7 is a block diagram of an electronic device for playing a sound source, according to an embodiment of the present disclosure.

FIG. 7 is a block diagram of an electronic device for playing a sound source, according to an embodiment of the present disclosure.

Referring to FIG. 7, an electronic device 701 includes a bus 710, a processor 720, a memory 730, an input/output interface 750, a display 760, and a communication interface 770. According to an embodiment of the present disclosure, the electronic device 701 may omit at least one of the components or may additionally include a different component.

The bus 710 is a circuit for connecting the components 710 to 770 to each other and delivering a communication (for example, control message and/or data) therebetween.

The processor 720 includes at least one of a central processing unit (CPU), an application processor (AP), and a communication processor (CP). The processor 720 executes calculations or data processing for control and/or communication of at least one other component of the electronic device 701.

The memory 730 includes volatile and/or nonvolatile memory. The memory 730 stores instructions or data relating to at least one another component of the electronic device 701. According to an embodiment of the present disclosure, the memory 730 stores software and/or program 740. The program 740 includes a kernel 741, a middleware 743, an application programming interface (API) 745, and/or an application 747. At least part of the kernel 741, the middleware 743, and the API 745 may be called an operating system (OS).

The kernel 741 controls or manages system resources (for example, the bus 710, the processor 720, and the memory 730) used for performing operations or functions implemented in other programs (for example, the middleware 743, the API 745, or the application 747). Additionally, the kernel 741 may provide an interface for controlling or managing system resources by accessing an individual component of the electronic device 701 from the middleware 743, the API 745, or the application program 747.

The middleware 743 serves as an intermediary role for exchanging data as the API 745 or the application 747 communicates with the kernel 741.

Additionally, the middleware 743 may process at least one job request received from the application 747 according to a priority. For example, the middleware 743 may assign to at least one application 747 a priority for using a system resource (for example, the bus 710, the processor 720, or the memory 730) of the electronic device 701. For example, the middleware 743 performs scheduling or load balancing on the at least one job request by processing the at least one job request according to the priority assigned to the at least one job request.

The API 745, is an interface for allowing the application 747 to control a function provided from the kernel 741 or the middleware 743, and may include at least one interface or function (for example, an instruction) for file control, window control, image processing, or character control.

The input/output interface 750 serves as an interface for delivering instructions or data input from a user or an external device 702 or 704 to other components of the electronic device 701. Additionally, the input/output interface 750 outputs instructions or data received from other components of the electronic device 701 to a user or the external device 702 or 704.

The display 760 may include a liquid crystal display (LCD), a light emitting diode (LED) display, an organic light emitting diode (OLED) display, a microelectromechanical systems (MEMS) display, or an electronic paper display. The display 760 may display various contents (for example, text, image, video, icon, symbol, and so on) to a user. The display 760 may include a touch screen, and may receive a touch, gesture, proximity, or hovering input by using an electronic pen or a user's body part.

The communication interface 770 sets a communication between the electronic device 701 and the first external electronic device 702, the second external electronic device 704, or the server 706. For example, the communication interface 770 communicates with the second external electronic device 704 or the server 706 in connection to the network 762 through wireless communication or wired communication.

The wireless communication, as a cellular communication protocol, may use at least one of long-term evolution (LTE), LTE Advance (LTE-A), code division multiple access (CDMA), wideband CDMA (WCDMA), universal mobile telecommunications system (UMTS), wireless broadband (WiBro), global system for mobile communications (GSM), and so on. Additionally, the wireless communication includes a short-range communication 764. The short range communication 764 includes at least one of wireless fidelity (WiFi), Bluetooth (BT), near field communication (NFC), global positioning system (GPS), and so on. The GNSS includes at least one of GPS, Glonass, Beidou navigation satellite system (Beidou) and Galileo, that is, the European global satellite-based navigation system. Hereinafter, GPS and GNSS may be interchangeably used.

The wired communication may include at least one of universal serial bus (USB), high definition multimedia interface (HDMI), recommended standard 232 (RS-232), plain old telephone service (POTS), etc. The network 762 is a telecommunications network, for example, at least one of computer network (for example, LAN or WAN), internet, and telephone network.

Each of the first and second external electronic devices 702 and 704 may have the same or different type from the electronic device 701. According to an embodiment of the present disclosure, the server 706 may include a group of one or more servers. All or part of operations executed on the electronic device 701 may be executed on the first external electronic device 702, the second external electronic device 704, or the server 706. When the electronic device 701 performs a certain function or service automatically or by a request, it may request at least part of a function relating thereto from the first external electronic device 702, the second external electronic device 704, or the server 706 instead of or in addition to executing the function or service by itself. The first external electronic device 702, the second external electronic device 704, or the server 706 executes the requested function or an additional function and delivers an execution result to the electronic device 701. The electronic device 701 provides the requested function or service as it is or by processing the received result additionally. For this cloud computing, distributed computing, or client-server computing technology may be used.

Figure 8:
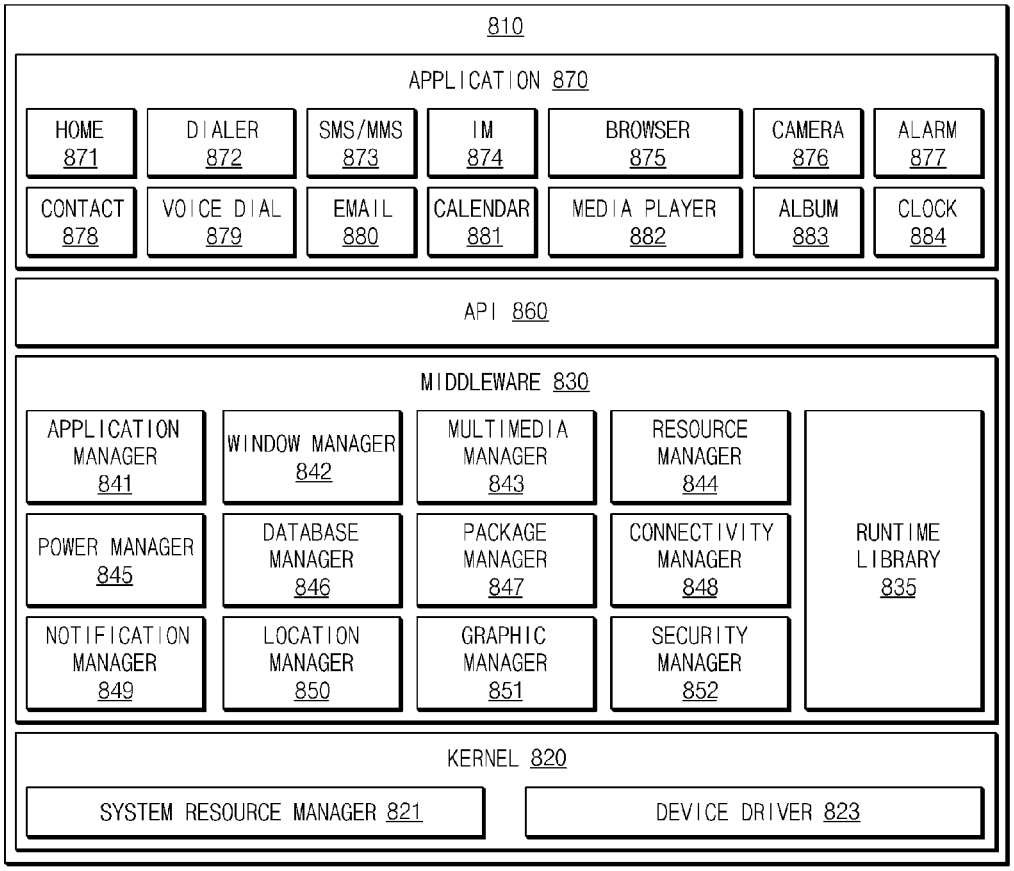
FIG. 8 is a block diagram of a program module of an electronic device, according to an embodiment of the present disclosure.

FIG. 8 is a block diagram of a program module of an electronic device, according to an embodiment of the present disclosure.

Referring to FIG. 8, a program module 810 (for example, the program 740) is provided. The program module 810 includes an operating system (OS) for controlling a resource relating to the electronic device 701 and/or the application 747 running on the OS. The OS may include Android, iOS, Windows, Symbian, Tizen, or Bada.

The program module 810 includes a kernel 820, a middleware 830, an application programming interface (API) 860, and/or an application 870. At least part of the program module 810 may be preloaded on the electronic device 701 or may be downloaded from the first external electronic device 702, the second external electronic device 704, and the server 706.

The kernel 820 includes a system resource manager 821, or a device driver 823.

The system resource manager 821 performs the control, allocation, or retrieval of a system resource. According to an embodiment of the disclosure, the system resource manager 821 may include a process management unit, a memory management unit, or a file system management unit.

The device driver 823 may be a display driver, a camera driver, a Bluetooth driver, a sharing memory driver, a USB driver, a keypad driver, a WiFi driver, an audio driver, or an inter-process communication (IPC) driver.

The middleware 830 provides a function that the application 870 requires commonly, or provides various functions to the application 870 through the API 860 in order to allow the application 870 to efficiently use a limited system resource inside the electronic device 701. According to an embodiment of the disclosure, the middleware 830 includes at least one of a runtime library 835, an application manager 841, a window manager 842, a multimedia manager 843, a resource manager 844, a power manager 845, a database manager 846, a package manager 847, a connectivity manager 848, a notification manager 849, a location manager 850, a graphic manager 851, and a security manager 852.

The runtime library 835 includes a library module that a complier uses to add a new function through a programming language while the application 870 is running. The runtime library 835 performs a function on input/output management, memory management, or an arithmetic function.

The application manager 841 manages the life cycle of at least one application among the application 870.

The window manager 842 manages a GUI resource used in a screen.

The multimedia manager 843 recognizes a format for playing various media files and encodes or decodes a media file by using the codec corresponding to a corresponding format.

The resource manager 844 manages a resource, such as a source code, a memory, or a storage space of at least any one of the applications 870.

The power manager 845 operates together with a basic input/output system (BIOS) to manage the battery or power and provides power information necessary for an operation of the electronic device 701.

The database manager 846 creates, searches, or modifies a database used in at least one application among the application 870.

The package manager 847 manages the installation or update of an application distributed in a package file format.

The connectivity manger 848 manages a wireless connection such as WiFi or Bluetooth.

The notification manager 849 displays or notifies of an event, such as arrival messages, appointments, and proximity alerts to a user in a manner of not interrupting the user.

The location manager 850 manages location information on the electronic device 701.

The graphic manager 851 manages a graphic effect to be provided to a user or a user interface relating thereto.

The security manager 852 provides various security functions necessary for system security or user authentication.

According to an embodiment, when the electronic device 701 includes a phone function, the middleware 830 may further include a telephony manager for managing a voice or video call function of the electronic device.

The middleware 830 may include a middleware module for forming a combination of various functions of the above-mentioned components. The middleware 830 may provide a module specialized for each type of OS to provide differentiated functions. Additionally, the middleware 830 may delete part of existing components or add new components dynamically.

The API 860 is a set of API programming functions, and may be provided as another configuration according to OS. For example, in the case of Android or iOS, one API set may be provided for each platform, and in the case of Tizen, at least two API sets may be provided for each platform.

The application 870 includes at least one application for providing functions such as a home 871, a dialer 872, an SMS/MMS 873, an instant message 874, a browser 875, a camera 876, an alarm 877, a contact 878, a voice dial 879, an e-mail 880, a calendar 881, a media player 882, an album 883, and a clock 884. Additionally or alternatively, health care (for example, measure an exercise amount or blood sugar level), or environmental information provision (for example, air pressure, humidity, or temperature information) applications may be provided.

According to an embodiment of the present disclosure, the application 870 may include an information exchange application for supporting information exchange between the electronic device 701 and the first external electronic device 702 and the second external electronic device 704. The information exchange application includes a notification relay application for relaying specific information to the external device or a device management application for managing the external electronic device.

The notification relay application relays to the first external electronic device 702 or the second external electronic device 704 notification information occurring from another application (for example, an SMS/MMS application, an e-mail application, a health care application, or an environmental information application) of the electronic device 701. Additionally, the notification relay application may receive notification information from an external electronic device and may then provide the received notification information to a user.

The device management application manages (for example, installs, deletes, or updates) at least one function (turn-on/turn off the external electronic device itself (or some components) or the brightness (or resolution) adjustment of a display) of the first external electronic device 702 or the second external electronic device 704 communicating with the electronic device 701, an application operating in the external electronic device, or a service (for example, call service or message service) provided from the external electronic device.

According to an embodiment of the disclosure, the application 870 may include a specified application (for example, a health care application of a mobile medical device) according to the property of the first external electronic device 702 or the second external electronic device 704. The application 870 may include an application received from the first external electronic device 702, the second external electronic device 704, or the server 706. The application 870 may include a preloaded application or a third party application downloadable from the server 706. The names of components in the program module 810 according to the shown embodiment may vary depending on the type of OS.

According to various embodiments of the present disclosure, at least part of the program module 810 may be implemented with software, firmware, hardware, or a combination thereof. At least part of the program module 810 may be implemented by the processor 720. At least part of the program module 810 may include a module, a program, a routine, sets of instructions, or a process to perform at least one function, for example.

The term "module" used in various embodiments of the present disclosure may refer to a unit including a combination of at least one of hardware, software, and firmware. The term "module" and the term "unit", "logic", "logical block", "component", or "circuit" may be interchangeably used. A "module" may be a minimum unit or part of an integrally configured component. A "module" may be a minimum unit performing at least one function or part thereof. A "module" may be implemented mechanically or electronically. For example, "module" may include at least one of an application-specific integrated circuit (ASIC) chip performing certain operations, field-programmable gate arrays (FPGAs), or a programmable-logic device, all of which are known or to be developed in the future.

According to various embodiments of the present disclosure, at least part of a device (for example, modules or functions thereof) or a method (for example, operations) according to this disclosure as in a form of a programming module, may be implemented using an instruction stored in computer-readable storage media. When at least one processor executes an instruction, a function corresponding to the instruction is performed. The non-transitory computer-readable storage media may include the memory 730.

The non-transitory computer-readable storage media may include hard disks, floppy disks, magnetic media (for example, magnetic tape), optical media (for example, compact disc read only memory (CD-ROM), and digital versatile disc (DVD)), magneto-optical media (for example, floptical disk), and hardware devices (for example, read only memory (ROM), random access memory (RAM), or flash memory). Additionally, a program instruction may include high-level language code executable by a computer using an interpreter, in addition to machine code created by a complier. The hardware device may be configured to operate as at least one software module to perform an operation of various embodiments of the present disclosure and vice versa.

A module or a programming module according to various embodiments of the present disclosure may include at least one of the above-mentioned components, may not include some of the above-mentioned components, or may further include another component. Operations performed by a module, a programming module, or other components may be executed through a sequential, parallel, repetitive or heuristic method. Additionally, some operations may be executed in a different order, may be omitted, or other operations may be added. Moreover, the embodiments disclosed in this specification are suggested for the description and understanding of technical content but do not limit the range of the present disclosure.

Accordingly, the scope of the present disclosure should be interpreted as including all modifications or various other embodiments based on the technical idea of the present disclosure. Therefore, the scope of the present disclosure is defined, not by the detailed description and embodiments, but by the following claims and their equivalents.

What is claimed is:

1. A speaker device comprising:

a housing;

a first speaker unit disposed at a front surface of the housing;

a second speaker unit disposed at the front surface;

a first passive radiator disposed at the front surface;

a second passive radiator disposed at a rear surface of the housing; and at least one structure disposed inside the housing, wherein one of the at least one structure is disposed between the first passive radiator and the second passive radiator and disposed to form a gap, through which air flows, between the one of the at least one structure and at least one of the housing, the first speaker unit, the second speaker unit, and another of the at least one structure, and wherein the first speaker unit, the second speaker unit, the first passive radiator, and the second passive radiator allow the air and heat to flow through them.

2. The speaker device of claim 1, wherein a first surface of the at least one structure faces the first passive radiator;

a second surface of the at least one structure faces the second passive radiator; and at least one of other surfaces of the at least one structure is spaced apart from the housing, the first speaker unit, or the second speaker unit.

3. The speaker device of claim 1, wherein the at least one structure comprises a first structure and a second structure; and the first structure and the second structure are arranged in parallel and spaced at a predetermined interval apart from each other.

4. The speaker of claim 1, wherein the at least one structure comprises a battery configured to supply power to the speaker device.

5. The speaker device of claim 4, wherein the at least one structure is removable and insertable through one surface of the housing.

6. The speaker device of claim 1, wherein while a sound source is played by the speaker device, flowing directions of air in the first speaker unit and the second speaker unit are opposite from flowing directions of air in the first passive radiator and the second passive radiator.

7. The speaker device of claim 1, wherein when air flows through the gap, a phase of the air is changed by at least 90°.

8. The speaker device of claim 7, wherein the gap allows the phase of the air to be changed by preventing a flow of the air.

9. The speaker device of claim 7, wherein at least one of an area of the gap and a length of the gap is determined to change the phase of the air by at least 90°.

10. The speaker device of claim 7, wherein a volume from the at least one structure to the front surface is determined to allow the phase of the air to be changed by at least 90°.

11. The speaker device of claim 1, wherein the first passive radiator and the second passive radiator are resonated at a predetermined frequency.

* * * * *